United States Patent [19]

Lucy

[11] Patent Number: 4,669,354

[45] Date of Patent: Jun. 2, 1987

[54] FULLY REDUNDANT MECHANICAL RELEASE ACTUATOR

[75] Inventor: Melvin H. Lucy, Virginia Beach, Va.

[73] Assignee: The United States of America as represented by the Administrator, of the National Aeronautics and Space Administration, Washington, D.C.

[21] Appl. No.: 729,704

[22] Filed: May 2, 1985

[51] Int. Cl.[4] ..... F02N 13/00

[52] U.S. Cl. ..... 89/1.14; 60/634; 60/638

[58] Field of Search ..... 89/1.14; 102/378; 60/638, 632, 634

[56] References Cited

U.S. PATENT DOCUMENTS

| | | | |
|---|---|---|---|
| 2,564,209 | 8/1951 | Murphy | 89/1.14 |
| 2,751,582 | 6/1956 | Kuykendall | 340/366 |
| 2,845,002 | 7/1958 | Ackerman, Jr. et al. | 89/1 |
| 3,084,597 | 4/1963 | Beyer | 89/1.14 |
| 3,196,745 | 7/1965 | Sustrich et al. | 89/1.14 |
| 3,354,634 | 11/1967 | McGirr | 89/1.14 |
| 3,612,857 | 3/1970 | Beatty et al. | 102/4 |
| 3,729,154 | 4/1973 | Deplante | 102/49.5 |
| 3,780,656 | 12/1973 | Murray | 102/37.6 |
| 3,885,451 | 5/1975 | Hamon | 89/1 B |
| 4,037,821 | 7/1977 | Greene | 60/638 |
| 4,054,032 | 10/1977 | Patrichi | 60/632 |
| 4,111,221 | 9/1978 | Olsen | 89/1.14 |

*Primary Examiner*—Frederick R. Schmidt
*Assistant Examiner*—Robert A. Rose
*Attorney, Agent, or Firm*—George F. Helfrich; John R. Manning

[57] ABSTRACT

A system is disclosed for performing a mechanical release function exhibiting low shock and includes two pyrotechnic detents fixed mounted in opposing axial alignment within a cylindrical housing having two mechanical bellows, each bellows having one end hermetically bonded to the housing and the other to the respective actuator pin extending from either end of the housing so that all outgassing and contamination from the operation of the pyrotechnic devices will be contained within the housing and bellows. The pin on one end of the assembly is fixed mounted and supported, via a bolt (FIGS. 1–3) or ball and socket joint (FIG. 4), so that when the charge corresponding to that pin ignites, the entire assembly will exhibit rectilinear movement, including the opposing pin providing the unlatching motion. The release detent pin is supported by a linear bearing and when its corresponding pyrotechnic charge ignites the pin is retracted within the housing producing the same unlatching motion without movement of the entire assembly, thus providing complete mechanical, electrical and pyrotechnic redundancy for the unlatching pin.

6 Claims, 4 Drawing Figures

FULLY REDUNDANT MECHANICAL RELEASE ACTUATOR

ORIGIN OF THE INVENTION

The invention described herein was made by an employee of the U.S. Government and may be manufactured and used by and for the Government for governmental purposes without the payment of any royalties thereon or therefor.

BACKGROUND OF THE INVENTION

This invention relates to the field of release mechanisms. More particularly, the invention is directed toward an apparatus for unlatching lens covers, gimbols, instrumentation covers, etc., on orbiting telescopes, optical instrumentation or other complex and highly sensitive space instrumentation packages, where functional reliability is of paramount concern and contamination must be virtually eliminated.

In space exploration, certain types of orbital instrumentation packages are employed that necessitate pin pulling release functions. The devices currently known in the art capable of performing the required pin pulling release functions are either bulky, heavy, expensive and lack full redundancy (in case of electrically operated solenoid devices) or in the case of pyrotechnic pin pullers, exhibit outgassing and condensation contamination that have the potential for compromising test and research data. Along with the problem of contamination, many current art devices exhibit unacceptably high shock levels upon release. Lower release shock is particularly needed in performing release functions on orbital telescopes and other optic research projects where the instrumentation is especially susceptible to shock damage.

A pyrotechnic detent minimizes size, weight and expense and has the added desired features of low initiation power requirements, high reliability and relatively low shock. A need exists in the field of orbital research for a device that preserves the economies enumerated while eliminating the corollary problem of release actuator contamination. It is also mandatory that functional reliability not be sacrificed in meeting this need, but conversely, improved reliability is requisite to preclude the necessity of aborting a long-term, complex and expensive space research project for want of opening an equipment access door.

A Halogen Occultation Experiment (HALOE) instrument is currently being developed as part of a National Aeronautics and Space Administration ongoing research program. HALOE will provide measurement technology for long duration monitoring of the stratospheric environment. Objectives include improved understanding of stratospheric ozone depletion and study of key chlorofluoromethane (CFM) impact on ozone and interactions with $ClO_x$, $NO_x$ and $HO_x$ chemistry. HALOE uses four gas filter correlation channels with thermal electric cooled IR detectors and four broadband radiometer channels with thermistor heliometers to measure eight stratospheric constituents of interest by the absorption of solar energy during sunrise and sunset events. Vertical profiles are obtained by tracking the solar disc during occultation.

After an appropriate period on-orbit to facilitate spacecraft outgassing a telescope door which prevented opcical contamination must be opened. Because of the extreme delicacy of the instrument and its heightened sensitivity to contamination, a system for effecting the telescope cover mechanical release function that is small, lightweight, contamination-free and has full redundancy of operation to ensure performance is desired.

Accordingly, it is an object of this invention to provide a release system that is contamination free when operated.

Another object of the present invention is to provide a mechanical release system that is redundant in all phases of operation (electrically, pyrotechnically and mechanically) to ensure functional reliability.

Yet another object of this invention is to provide a release system that minimizes release shock by channeling the shock to rectilineal motion along the axis of a pin release mechanism.

It is also an object of the present invention to provide a release system that is longitudinally symmetrical and cannot be inadvertently installed backward.

An additional object of the present invention is to provide a highly reliable release system that is of lightweight construction, of small size, has low initiation energy requirements and performs with reduced pyroshock effects.

STATEMENT OF THE INVENTION

According to the present invention the foregoing and additional objects of the present invention are attained by providing a mechanical pin release system consisting of two pyrotechnic pin pullers located inside a cylindrical housing. These pin pullers are fixed mounted within the housing in opposing axial alignment so that the pins exit either end of the housing. These devices are configured with standard 1 AMP 1 Watt bridge wire igniters. The electrical leads from these devices plug into a conventional electrical terminal firing circuit within the housing. The external wiring connecting the terminal block to remote firing circuits egress the housing through wiring access holes and the electrical area within the case is filled with potting compound to seal and maintain airtight integrity in the pyrotechnic pin puller compartments on either end of the housing. A metallic bellows assembly incorporating a flexible bellows attached to a rigid end cap is affixed to the mechanism by hermetically bonding the free end of the bellows to the outside of the housing. The rigid end cap of each bellows assembly is hermetically bonded to the end of the bellows and is attached to the retraction pins protruding from the pyrotechnic pin pullers which extend from either end of the housing. This results in the area within the bellows having airtight integrity.

Each rigid end cap is provided with an integral protruding elongated pin which serves as pin extenders for the pins exiting each end of the pyrotechnic device. The end of each of the pin extenders internal to the bellows assemblies is affixed to the corresponding pyrotechnic pin puller pin so that when the pyrotechnic pin puller ignites and retracts its pin internal to itself, the end cap will also be pulled inward and collapse the bellows. The external ends of each end cap pin extension are tapped. One of the pin extensions serves to attach the release assembly to the support structure and the other serves as a retractable detent for maintaining and releasing a device as will be further explained hereinafter. Thus, when either pyrotechnic pin puller is energized, all outgassing and contamination is trapped within the bellows and the housing.

The pin immobilized against linear movement is firmly attached to the support structure, resulting in the entire release device being pulled toward the support structure when the pyrotechnic pin puller corresponding to that end is energized. As the release device pulls itself onto this immobilized pin, the pin extender on the other end of the device is pulled free performing the unlatching function. This unlatching pin extension rides in and is supported by a linear bearing enhancing stability.

The same unlatching motion may be obtained by igniting the pyrotechnic pin puller corresponding to the pin extension performing the unlatching motion. When this pin puller is energized the release assembly cannot move as it is attached to the mounting plate by a suitable bolt or through a ball and socket joint that prevents linear movement of the pin, resulting in the unlatching pin being pulled internal to the pyrotechnic pin puller and effecting the same unlatching stroke. The mounting plate and bolt or ball and socket joint on the fixed end bears the load when either pyrotechnic pin puller is energized and it is always the opposite pin extension that exhibits the unlatching motion. In this manner, the unlatching function is performed when either or both pyrotechnic pin pullers are ignited; the first by pulling the entire releasing system toward the fixed mounted end and the second by normal operation of the retracting pyrotechnic pin puller pulling its corresponding pin internal to itself. Thus, full mechanical and pyrotechnic redundancy is obtained. It is important to note that the invention is longitudinally symmetrical and performs the same independent of which end is fixed mounted, thus precluding backward installation.

BRIEF DESCRIPTION OF THE DRAWINGS

A more comprehensive appreciation of the invention and many of the attendant advantages thereof will be readily apparent as the same becomes better understood by reference to the following description when considered in connection with the accompanying drawings wherein.

DETAILED DESCRIPTION OF THE INVENTION

Figure 1:
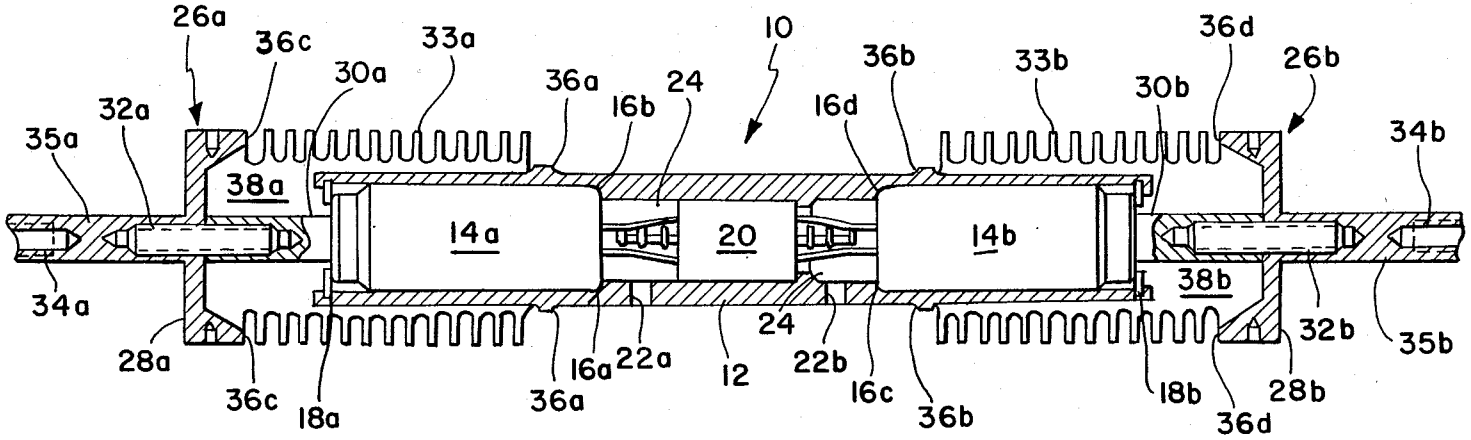
FIG. 1 is a perspective view of the preferred embodiment of the present invention utilizing pyrotechnic pin pullers.

Referring now to the drawings wherein like elements are referred to by the same reference numeral throughout the several views and more particularly to FIG. 1, the numeral 10 generally designates the preferred embodiment of the release system of the present invention. As shown therein, a housing 12 is provided with two internal cavities to snugly contain two pin retractor or puller devices 14*a* and 14*b*. In the specific embodiment illustrated, the pyro-technic pin retractors or pullers are commercially available with 1 AMP 1 Watt bridgewires, exhibiting a 0.313 inch stroke with a minimum of 20 pounds retraction force. These retractable actuators are available as Model No. 1MT18 from ICI-America, Valley Forge Corporate Center, Valley Forge, Penna. The pin pullers 14*a* and 14*b* are mounted within housing 12 with their shell or body ends on the electrical ends thereof butted against the recessed interior lips 16*a*, 16*b*, 16*c* and 16*d* of housing 12 and held firmly therein by respective snap or retainer rings 18*a*, 18*b* in such a manner that the pyrotechnic pin pullers 14*a*, 14*b* and housing 12 act as one unit.

An electrical terminal block 20 is mounted in the center of housing 12 and provides the electrical interface between pyrotechnic pin pullers 14*a*, 14*b* and the external wiring. Wiring access holes 22*a* and 22*b* in housing 12 (shown rotated 90° for convenience) provide egress for the wiring to duel remote firing circuits (not shown). The entire wiring cavity 24 within housing 12 is filled with potting compound, sealing the center of the housing containing the electrical wiring access holes.

Two bellows assemblies 26*a* and 26*b* are employed in the present invention. Each bellows 33*a*, 33*b* in the illustrated embodiment has fourteen convolutions, with an outer diameter of 0.746 inch and an inner diameter of 0.490 inch, hermetically bonded at one end to housing 12 at 36*a* and 36*b* and at the other end, to end caps 28*a* and 28*b* at 36*c* and 36*d*. End caps 28*a* and 28*b* are each provided with a pin extender portion 35*a*, 35*b* as an integral part thereof that connect via set screws 32*a* and 32*b* to lengthen the pyrotechnic pin puller pins 30*a* and 30*b* extending from either end of housing 12. The pin extensions 35*a* and 35*b* on the end caps are tapped at 34*a* and 34*b*, facilitating affixing one of the end cap pin extenders 35*a* or 35*b* to a mounting plate by use of a suitable bolt 42 (FIG. 2) or the ball and socket joint (FIG. 4).

Again referring to FIG. 1, the bellows assemblies 26*a* and 26*b* are hermetically bonded to the outside diameter of housing 12 at 36*a* and 36*b*. The bellows end caps 28*a*, 28*b* are also hermetically bonded to the pyrotechnic pin puller pins 30*a* and 30*b* at points 36*c* and 36*d*, resulting in the area within the bellows, 38*a* and 38*b*, being completely sealed from the outside environment.

As stated hereinabove, the pyrotechnic pin pullers 14*a* and 14*b* shown in the preferred embodiment are retractable actuators with 1 AMP 1 Watt bridgewires and may be procured commercially. The internal operation of the pyrotechnic pin pullers is generally known to those skilled in the art and consists of expanding pyrotechnic gases released upon ignition being routed behind a piston (not shown) connected to the release pin 30*a* or 30*b* in such a manner that the piston is forced internally within the device pulling the pin 30*a* or 30*b* with it. The retractable actuators employed herein exhibit a 0.313 inch stroke with a minimum 20 pound retraction force when ignited and have an internal antirebound mechanism to preclude the possibility of the pin re-exiting the pyrotechnic pin puller when gases abate.

Figure 4:
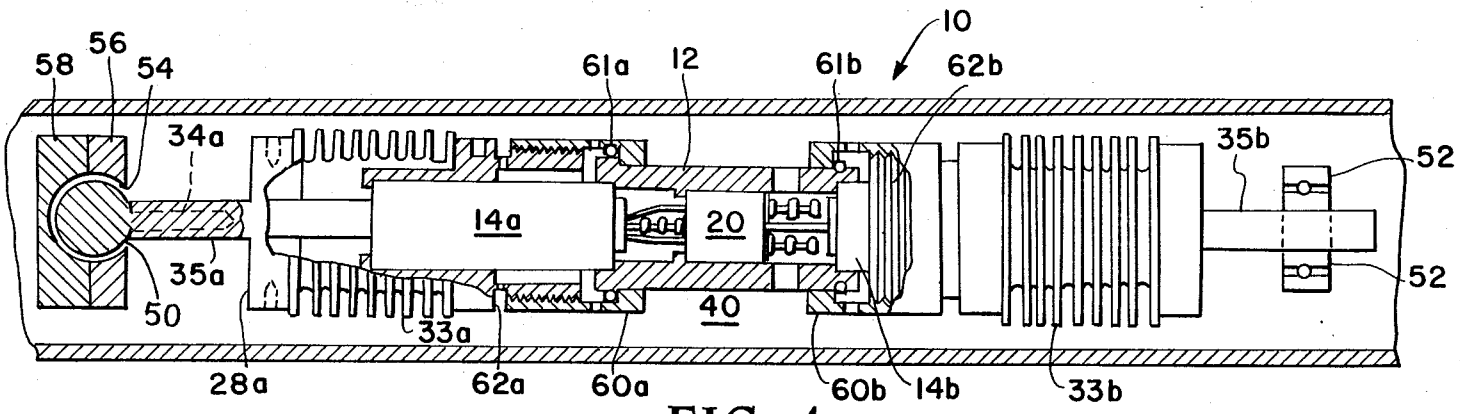
FIG. 4 illustrates a modified embodiment of the present invention supported by bearings and assembled using locking nuts instead of retention rings or crimped housings.

Referring now to FIG. 4, a slight modification of the invention is illustrated. In this embodiment, pin extension 35*a* is provided with a spherical bearing 50 threadingly attached thereto by a suitable threaded extension from bearing 50 and received by tapped opening 34*a*. Spherical bearing 50 acts as a ball joint received by socket 54 formed in fixed split housing 56, 58. Thus, the ball and socket connection permits pivotal and rotative movement for release system 10 while restricting linear movement thereof. This essentially universal movement of system 10 allows for better alignment of the release system 10 during installation. Also, in this embodiment, each bellows and pin puller assembly is directly attached to a short central housing 12 via nuts 60*a* and 60*b* with respective O-rings 61*a* and 61*b* ensuring sealing of the connections. Nuts 60*a* and 60*b* engage threaded sleeves 62*a* and 62*b*, respectively, positioned around pin pullers 14*a* and 14*b*. Bellows 33*a* and 33*b* in this embodiment are hermetically sealed to the respective sleeves 62*a* and 62*b*.

Operation of the Invention

Figure 2:
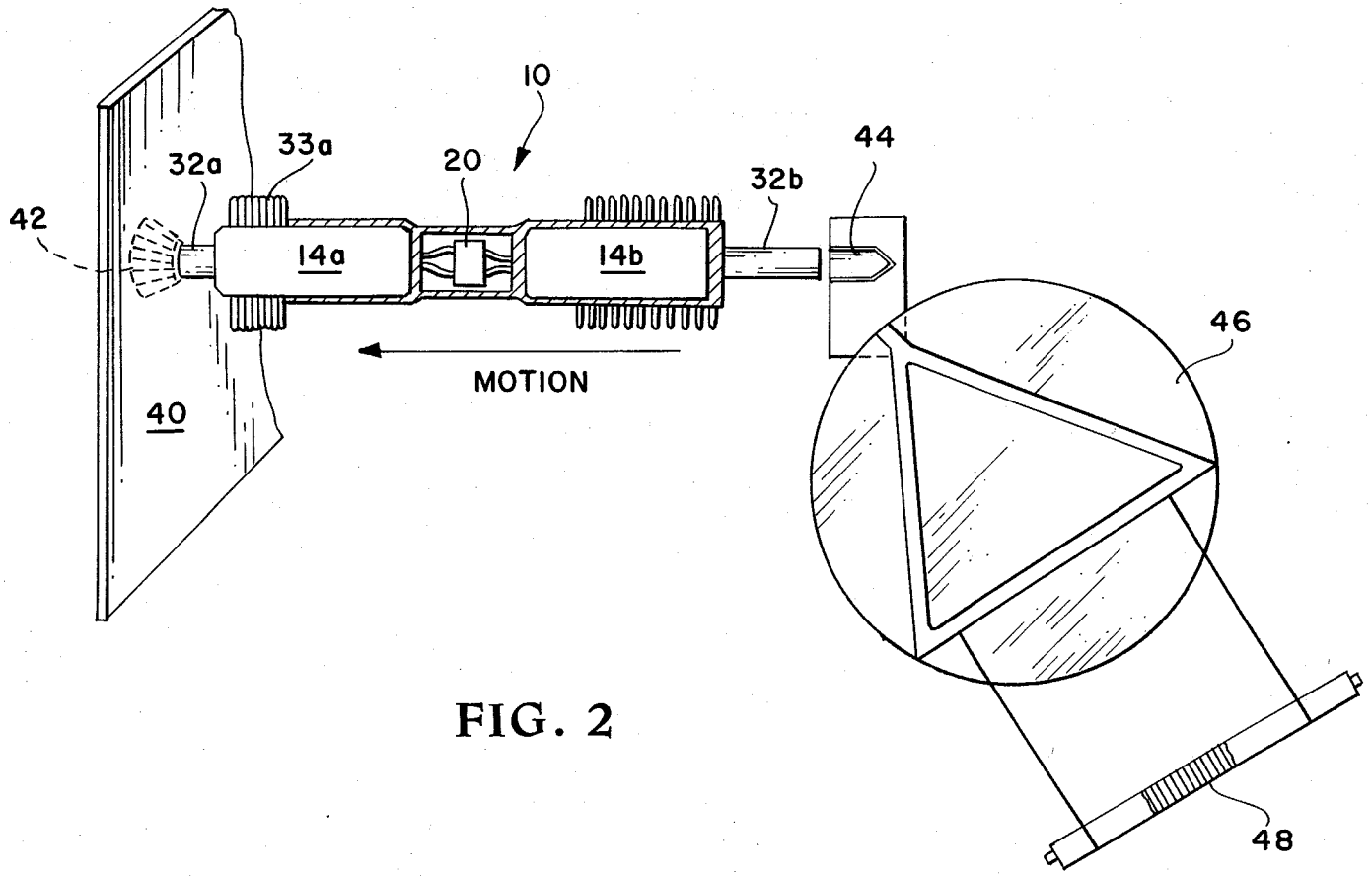
FIG. 2 is a part schematic view of the system shown in FIG. 1 in its operating environment and illustrating the operation when the fixed end pyrotechnic pin puller is energized.

The operation of the invention is now believed apparent. Referring now to FIG. 2, release assembly 10 is mounted to frame 40 of the equipment package employing the invention as a mechanical release by attaching fixed pin extension 35*a* to frame 40 with a suitable bolt or thumb screw 42. The bolt 42 and frame 40 bear the entire operating load when assembly 10 releases. When the pyrotechnic pin puller 14*a* ignites, expanding gases are routed behind a piston within the device in such a manner as to exert retraction force on its corresponding pin (Internal operation of the pyrotechnic pin puller is not illustrated). The pyrotechnic release pin is secured to frame 40 by bolt 42 precluding normal movement of the pin puller release pin and resulting in movement of the entire release assembly 10 toward frame 40 and bolt 42. As assembly 10 moves toward the support frame by pulling itself onto the immobilized pin 35*a* and collapsing bellows 26*a*, the release pin extender 35*b* is pulled free of equipment door latching hole 44 and equipment door 46 is propelled open by door spring 48.

The action of bellows 33*a* collapsing provides shock absorption as the bellows compartment (FIG. 1, 38*a*) is sealed at atmospheric pressure (14.7 psia) and increases to 1.41 atmospheres when the bellows collapse, thus reducing functioning shock. All outgassing of the pyrotechnic detent upon ignition, along with all other contaminates such as condensation, are contained within the bellows assembly in area 38*a* of FIG. 1.

Figure 3:
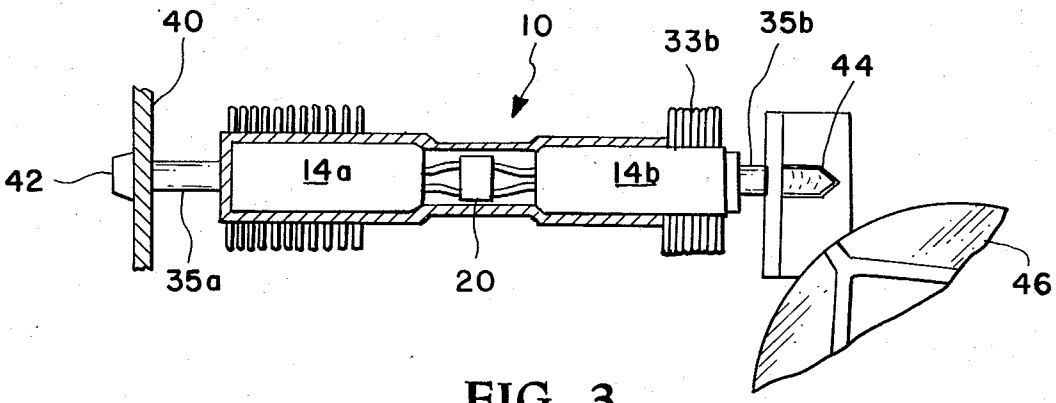
FIG. 3 is a view similar to FIG. 2 illustrating the system operation when the pyrotechnic pin puller on the releasing end is energized.

When the opposing pyrotechnic pin puller 14*b* is actuated, as shown in FIG. 3, the corresponding pin 30*b* (FIG. 1) is pulled internal to the pyrotechnic pin puller 14*b*. Pin 30*b* of FIG. 1 is attached to pin extension 35*b* of FIG. 3 which is pulled free of latching hole 44, allowing the equipment door to open as described above. Bellows 33*b*, shown collapsed in FIG. 3, provide the same shock absorption properties described above as they contract and raise internal pressure from 1 to 1.41 atmospheres upon operation.

When both pyrotechnic detents are ignited as shown in (FIGS. 2 and 3 combined), the releasing force extended on unlatching pin 35*b* is doubled to a minimum of 40 pounds and the unlatching stroke is doubled to 0.626 inch. The unlatching force and stroke necessary to unlatch door 46 is adequate when either of the pyrotechnic pin pullers 14*a*, 14*b* ignites, giving the invention full redundancy of operation by igniting both pin pullers from different power supplies, either simultaneously or sequentially.

This combination provides a system of mechanically releasing a locking pin 35*a*, or 35*b* that is fully redundant and that exhibits a minimum 0.313 inch stroke with a minimum twenty pound retraction force when either of the pyrotechnic devices 14*a*, 14*b* are energized. If the mechanical release function requires no more than twenty pounds of retraction force and a releasing stroke of no more than 0.313 inch, igniting both pyrotechnic pin pullers 14*a* and 14*b* results in redundant operation both mechanically and pyrotechnically. Electrical redundancy is achieved with dual electrical firing circuits (not shown), making the device fully redundant.

Although the pin pullers 14*a* and 14*b* are shown as being held firmly within housing 12 by snap rings 18*a* and 18*b*, this element may be omitted and housing 12 may be crimped at each end to reduce the end diameter portion thereof and firmly retain pin pullers 14*a* and 14*b* therein. These and other variations and modifications of the invention will be readily apparent to those skilled in the art in the light of the above teachings. Thus, within the scope of the appended claims, the invention may be practiced other than as specifically described herein.

What is claimed as new and desired to be secured by Letters Patent of the United States is:

1. A fully redundant, release system providing linear release motion to a containment pin comprising, in combination:

a cylindrical housing;

two pyrotechnic pin pullers supported and linearly spaced within said housing;

said pyrotechnic pin pullers each having an electrically actuated pyrotechnic charge at one end thereof;

an electrical terminal block disposed between and in electrical connection with said pyrotechnic charges;

access openings in said housing to permit electrical leads extending from said electrical terminal block to pass through said housing for connection with a suitable power source;

two retractable bellows assemblies encompassing either end of said housing;

each said bellows assembly having a rigid end cap and a flexible expansion bellows portion;

a rigid pin member integral with each said rigid end cap;

said flexible bellows portion of each said bellows assembly having one end thereof hermetically sealed to said rigid end cap and the other end thereof hermetically sealed to the exterior of said housing;

one said rigid pin member serving to connect the release system to a support surface;

the other of said rigid pins serving as a release detent and slidably extending into a device that is to be released;

whereby actuation of either of said pyrotechnic pin pullers will cause rectilinear releasing force to said rigid spin serving as a release detent while containing all pyrotechnic contaminates within said bellows assembly.

2. A fully redundant, symmetrical releasing system according to claim 1 including spherical bearing means supporting and assisting in immobilizing said rigid pin member serving to connect said housing to a support surface, and linear bearing means supporting and permitting linear movement of said other rigid pin serving as a release detent and extending into a device that is to be released.

3. The release system of claim 1 including each said rigid pin having a tapped end and a threaded member received by and serving to secure said one rigid pin to the support surface.

4. The release system of claim 1 wherein said one rigid pin serving to connect the release system to a support surface includes a tapped end, a spherical bearing having a threaded appendage received by said tapped end, said spherical bearing serving as the ball member of a ball and socket joint and means attached to said support surface receiving said spherical bearing and serving as the socket portion of the ball and socket joint.

5. The release system of claim 3 including a fixed plate member serving as the support surface and said threaded member extends through said fixed plate member to threadingly engage the tapped end of said one rigid pin.

6. A release system for an object comprising:

a detent pin slidably received by and retaining an object to be released;

support means for retaining said detent pin in position to retain said object to be released and supporting said detent pin after release of the object, the support means including an elongated tubular housing containing at least one pyrotechnic charge which, when actuated, releases gases effecting linear movement of said detent pin from said object to be released;

a bellows unit for containing the gases from said pyrotechnic charge to prevent contamination of the object released, said bellows unit including a rigid cap member and a flexible expansion portion, said flexible expansion portion having one end thereof hermetically sealed to the exterior of said elongated tubular housing, said rigid cap member hermetically sealing the other end of said flexible expansion portion, and said detent pin being integral with and extending through said rigid cap member; and a rigid pin member extending from said elongated tubular housing for mounting the release system.

* * * * *